US007040671B2

(12) United States Patent
Liu

(10) Patent No.: US 7,040,671 B2
(45) Date of Patent: May 9, 2006

(54) LOCK ASSEMBLY WITH TWO HOOK DEVICES

(76) Inventor: Chuen-Yi Liu, deceased, late of Pingtung Hsien (TW); by Jyh-Huey Su, legal representative, No. 17-19, Shiah-Tsuoh Street, Der-Rong Tsuen, Charng-Jyh Shiang, Pingtung Hsien (TW)

( * ) Notice: Subject to any disclaimer, the term of this patent is extended or adjusted under 35 U.S.C. 154(b) by 192 days.

(21) Appl. No.: 10/827,506

(22) Filed: Apr. 19, 2004

(65) Prior Publication Data

US 2004/0195841 A1 Oct. 7, 2004

Related U.S. Application Data

(63) Continuation-in-part of application No. 10/352,432, filed on Jan. 28, 2003, now abandoned.

(51) Int. Cl.
*E05C 19/10* (2006.01)

(52) U.S. Cl. ..... 292/24; 292/26; 292/48; 292/51; 292/95; 292/96; 292/97; 292/116; 292/117; 292/DIG. 46; 70/95; 70/100; 70/224

(58) Field of Classification Search ..... 292/113, 292/22, 24, 26, 27, 48, 51, 56, 95, 96, 97, 292/116, 117, 196, 199, 280, DIG. 46, 5, 292/6; 70/91, 95, 100, 224
See application file for complete search history.

(56) References Cited

U.S. PATENT DOCUMENTS 335,175 A * 2/1886 Blathwayt ..... 292/51
1,320,444 A * 11/1919 Buczynski et al. ..... 70/97
2,701,157 A * 2/1955 Le Bon, III ..... 292/113
2,739,002 A 3/1956 Johnson
2,916,317 A 12/1959 Diday
2,924,475 A * 2/1960 Russell ..... 292/129
2,928,689 A * 3/1960 Mineah ..... 292/113
3,019,043 A * 1/1962 Woodworth et al. ..... 292/113
3,175,376 A * 3/1965 Cantwell ..... 70/131
3,400,562 A 9/1968 Bloss
3,413,025 A 11/1968 Sperry
3,586,360 A 6/1971 Perrotta
3,899,201 A 8/1975 Paioletti
4,416,126 A 11/1983 Remington
5,595,409 A * 1/1997 Fier et al. ..... 292/112
5,702,134 A 12/1997 Hsieh
5,722,704 A 3/1998 Chaput et al.

(Continued)

*Primary Examiner*—Brian E. Glessner
*Assistant Examiner*—Carlos Lugo
(74) *Attorney, Agent, or Firm*—Alan D. Kamrath; Nikolai & Mersereau, P.A.

(57) ABSTRACT

A lock assembly includes a casing, two pivotable members pivotally mounted in the casing and meshed with each other, two linking rods, and two hook device each including a hook member and a rocker arm that is pivotally mounted in the casing. Each hook member has a first end pivotally connected to an associated rocker arm and a hooked second end that is passable through an associated one of two openings of the casing. When either pivotable member is pivoted, each rocker arm and each hook member are actuated such that the hooked second end of each hook member is moved between a retracted position in the casing and a locking position out of the casing. Damage to the hooked second ends of the hook members during closing of a door is prevented.

8 Claims, 8 Drawing Sheets

U.S. PATENT DOCUMENTS

| | | | | |
|---|---|---|---|---|
| 5,820,170 | A | 10/1998 | Clancy | |
| 5,906,403 | A | 5/1999 | Bestler et al. | |
| 5,951,068 | A | 9/1999 | Strong et al. | |
| 6,264,252 | B1 | 7/2001 | Clancy | |
| 6,327,879 | B1 * | 12/2001 | Malsom | 70/97 |
| 6,454,320 | B1 | 9/2002 | Weinerman et al. | |
| 6,502,435 | B1 | 1/2003 | Watts et al. | |
| 6,502,868 | B1 | 1/2003 | Laspa et al. | |
| 6,672,632 | B1 * | 1/2004 | Speed et al. | 292/25 |
| 6,682,109 | B1 * | 1/2004 | Horne et al. | 292/22 |
| 6,776,441 | B1 * | 8/2004 | Liu | 292/26 |
| 2003/0116973 | A1 | 6/2003 | Liu | |

* cited by examiner

LOCK ASSEMBLY WITH TWO HOOK DEVICES

CROSS REFERENCE TO RELATED APPLICATION

This is a continuation-in-part application of U.S. patent application Ser. No. 10/352,432 filed Jan. 28, 2003, which is now abandoned.

BACKGROUND OF THE INVENTION

1. Field of the Invention

The present invention relates to a lock assembly with two hook devices for reliably locking a door.

2. Description of the Related Art

A wide variety of locks have heretofore been provided for different purposes. Typically, a lock includes a single latch bolt for providing the latching function. The latching function provided by the single latch bolt is apt to be destroyed. U.S. patent application Ser. No. 10/298407, which is now U.S. Pat. No. 6,776,441, disclosed a lock assembly with two hook devices to solve this problem. As illustrated in FIG. 1 of the drawings, the lock assembly disclosed in U.S. patent application Ser. No. 10/298,407 comprises a casing 1 having two openings 14, a pivotable member 11 pivotally mounted in the casing 1, two linking rods 13 respectively provided on two sides of the pivotable member 11, each linking rod 13 including a first end pivotally connected to the pivotable member 11 and a second end, and two hook devices 12 each including a hook member 122 and a rocker arm 121. Each rocker arm 121 is pivotally mounted in the casing 1. The second end of each linking rod 13 is pivotally connected to an associated rocker arm 121. Each hook member 122 includes a first end 123 pivotally connected to the rocker arm 121 and a hooked second end 124 that is passable through an associated opening 14 of the casing 1. When the pivotable member 11 is pivoted, each hook member 122 is actuated such that the hooked second end 124 of each hook member 122 is moved between a retracted position in the casing 1 and an extended position out of the casing 1. However, the casing 1 must include a protruded portion 10 on an inner end thereof for shielding pivotal movement of the inner one of the linking rods 13 (the upper one in FIG. 1). As a result, the mounting hole of a door (e.g., a sliding door) in which the lock assembly is mounted must be deepened.

SUMMARY OF THE INVENTION

An object of the present invention is to provide a dual-hook type lock assembly that has a casing with a reduced width, allowing the casing to be conveniently mounted in the mounting hole of the door.

A lock assembly in accordance with the present invention comprises:

a casing having two openings, the casing further including two stops provided thereon;

two pivotable members pivotally mounted in the casing, the pivotable members being so configured that rotation of one of the pivotable members causes rotation of the other pivotable member;

two linking rods each having a first end pivotally connected to an associated one of the pivotable members and a second end; and two hook devices each including a hook member and a rocker arm, each said rocker arm being pivotally mounted in the casing, the second end of each said linking rod being pivotally connected to an associated one of the rocker arms, each said hook member having a first end pivotally connected to an associated one of the rocker arms, each said hook member further including a hooked second end that is passable through an associated one of the openings of the casing, each said hook member further including an intermediate portion located adjacent to an associated one of the stops;

wherein when either of the pivotable members is pivoted, each said rocker arm and each said hook member are actuated such that the hooked second end of each said hook member is moved between a retracted position in the casing and a locking position out of the casing; and wherein when the hooked second end of each said hook member is in the locking position and subjected to an impact exceeding a predetermined extent, each said hook member moves inward, with the intermediate portion of the hook member pressing against the associated one of the stops, causing the hook member to move to thereby retract the hooked second end of each said hook member into the casing.

Other objects, advantages, and novel features of the invention will become more apparent from the following detailed description when taken in conjunction with the accompanying drawings.

DETAILED DESCRIPTION OF THE PREFERRED EMBODIMENT

Figure 2:
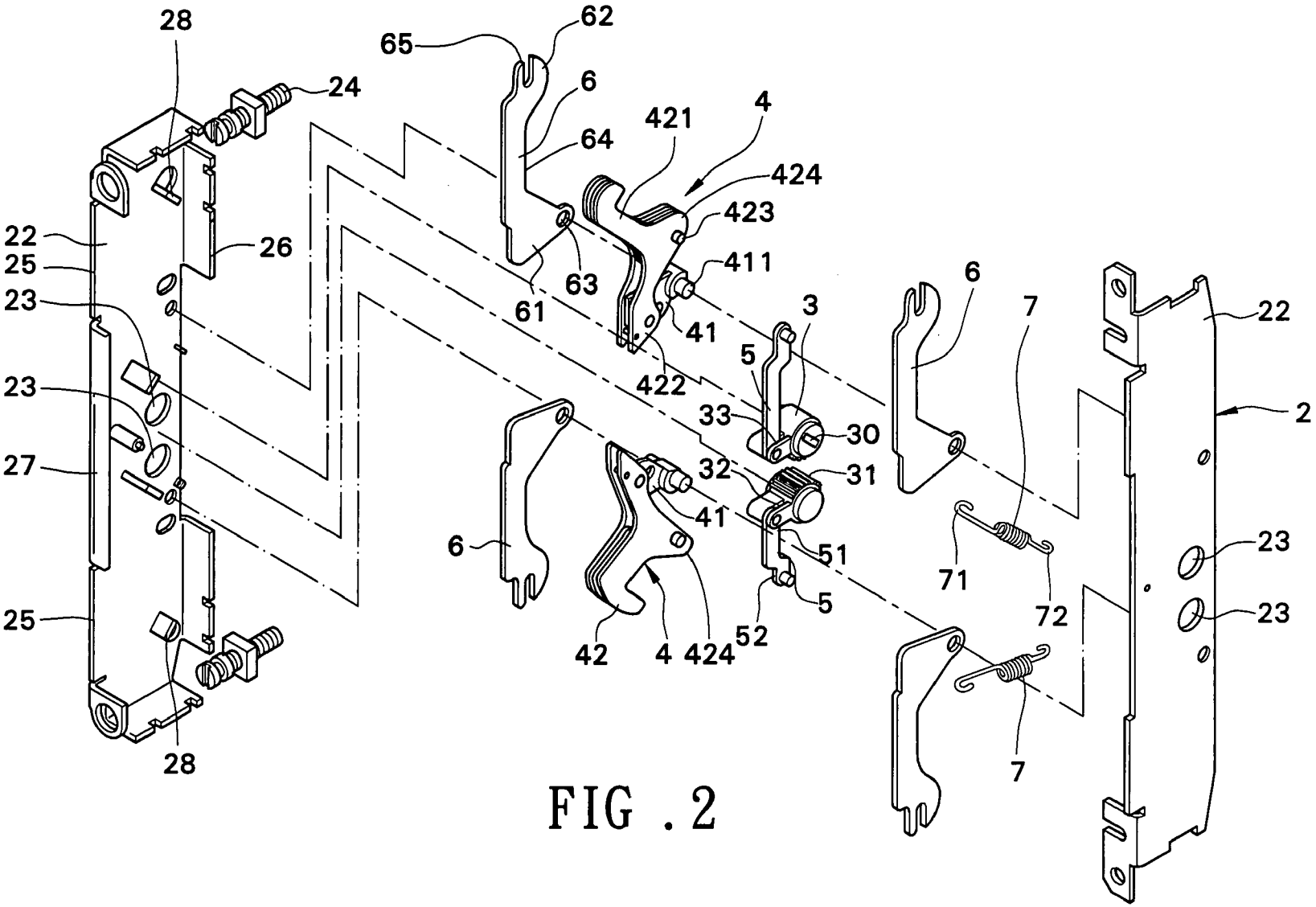
FIG. 2 is an exploded perspective view of a lock assembly in accordance with the present invention.
Figure 3:
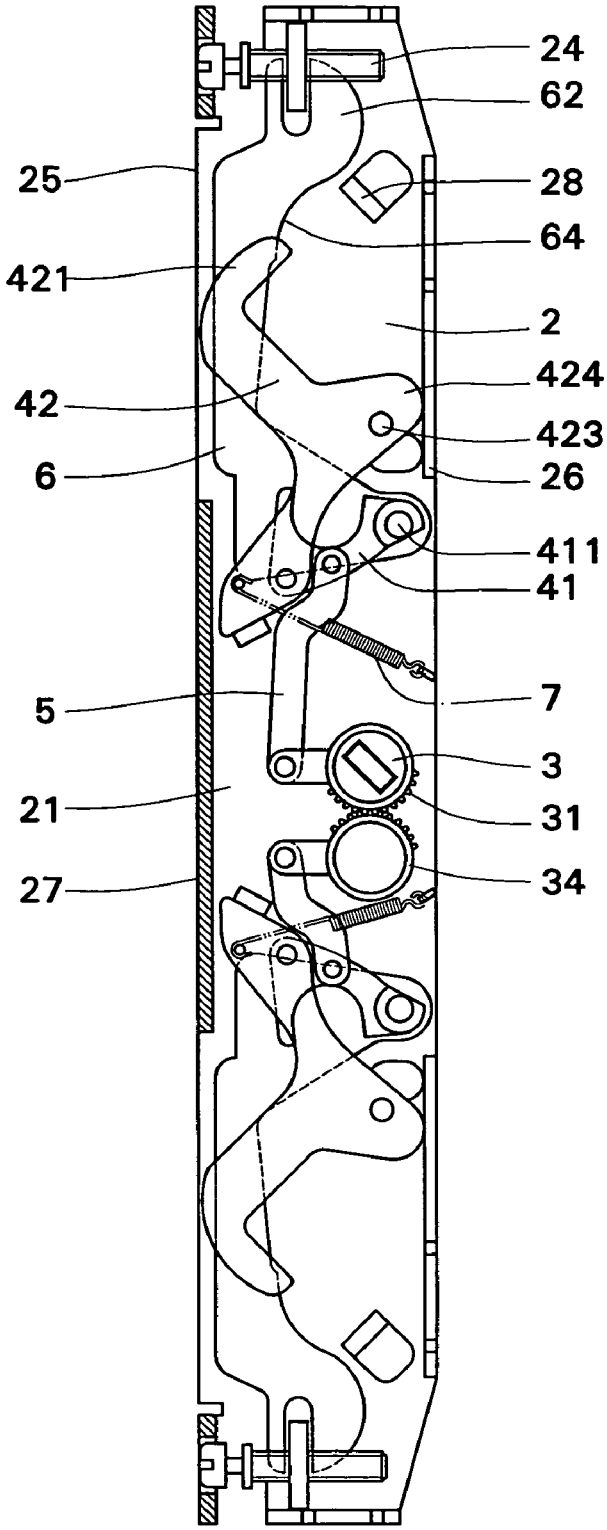
FIG. 3 is a side view of the lock assembly with one casing half being removed to show interior structure.

Referring to FIGS. 2 and 3, a lock assembly in accordance with the present invention generally comprises a casing 2 consisting of two casing halves 22 that together define two openings 25 spaced from each other. Two pivotable members 3 are pivotally mounted in the casing 2. In this embodiment, the pivotable members 3 are pivotally held in aligned holes 23 of the casing halves 22. Each pivotable member 3 includes a toothed portion 31, allowing the pivotal members 3 to mesh with each other such that rotation of either of the pivotal members 3 causes rotation of the other. Each pivotable member 3 further includes a protruded portion or lobe 33 for pivotal connection with a first end 51 of a linking rod 5. Preferably, the lobe 33 of each pivotable member 3 has a slot 33 to allow pivotal movement of the respective linking rod 5.

Two hook devices 4 are accommodated in the casing 2 and each includes a hook member 42 and a rocker arm 41. Each hook member 42 further includes a peg 423 on an intermediate portion 424 thereof. The rocker arm 41 includes a stub 411 that is pivotally engaged in aligned holes (not labeled) of the casing halves 22. Each linking rod 5 has a second end 52 that is pivotally connected to an associated rocker arm 41. Each hook member 42 includes a first end 422 that is pivotally connected to an associated rocker arm 41 and a hooked second end 421 that is movable from a retracted position in the casing 2 (FIG. 3) to an extended position outside the casing 2 (FIG. 5) in which the peg 423 of the hook member 42 moves upward along an inner edge 64 of an associated one of two guide plates 6, which will be described later.

Figure 5:
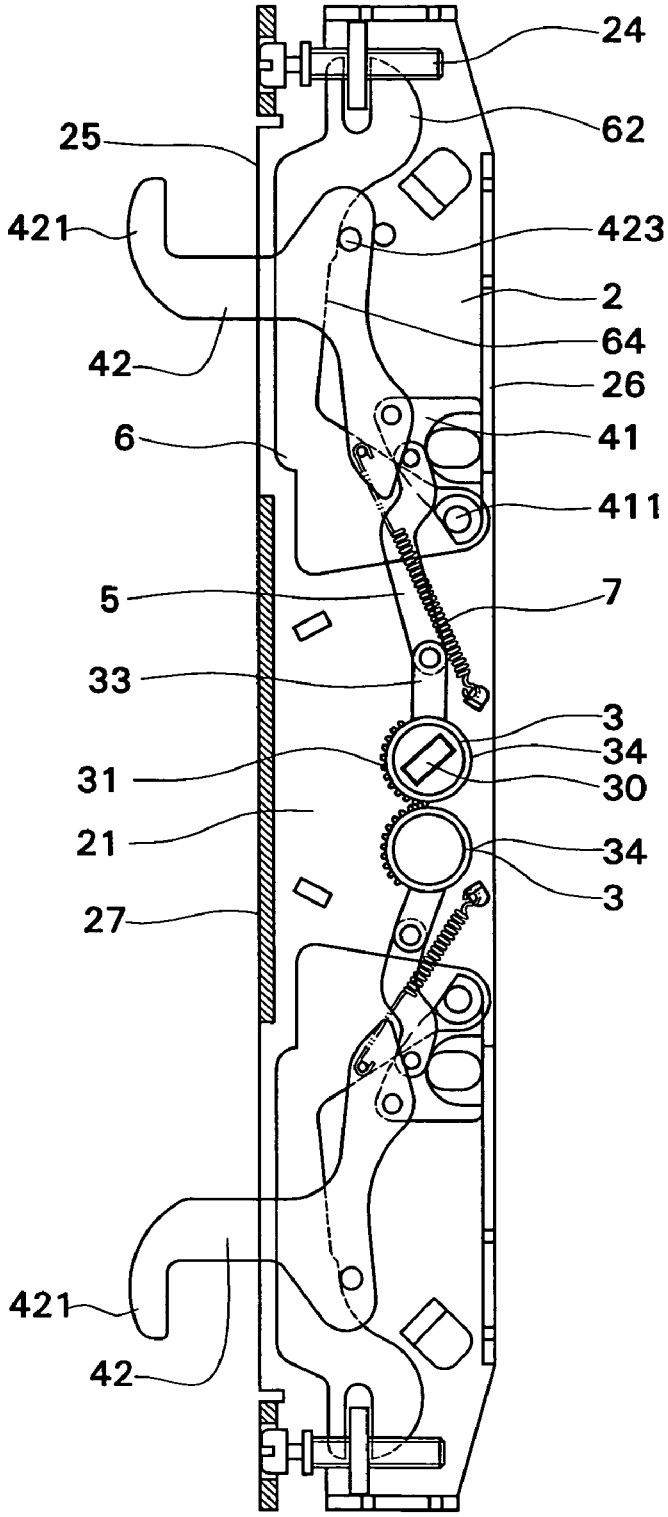
FIG. 5 is a side view similar to FIG. 3, wherein the lock assembly is in a locking state.

Two springs 7 are provided and each includes a first end 71 attached to an associated hook member 42 and a second end 72 attached to the casing 2. Referring to FIGS. 2, 3, and 5, the lock assembly in accordance with the present invention further includes two guide plates 6 and two adjusting bolts 24 for each hook device 4. Nevertheless, only one guide plate 6 and only one adjusting bolt 24 can be used when desired. Each guide plate 6 includes a first end 61 having a hole 63 that is extended through by the stub 411 of the respective rocker arm 41. Thus, the first end 61 of the guide plate 6 is pivotally connected to the stub 411 of the respective rocker arm 41. Each guide plate 6 further includes a second end 62 having a notch 65 for engaging with an associated adjusting bolt 24. When the respective adjusting bolt 24 is turned, the respective guide plate 6 pivots to thereby adjust the extended length of the respective hook member 42.

Figure 8:
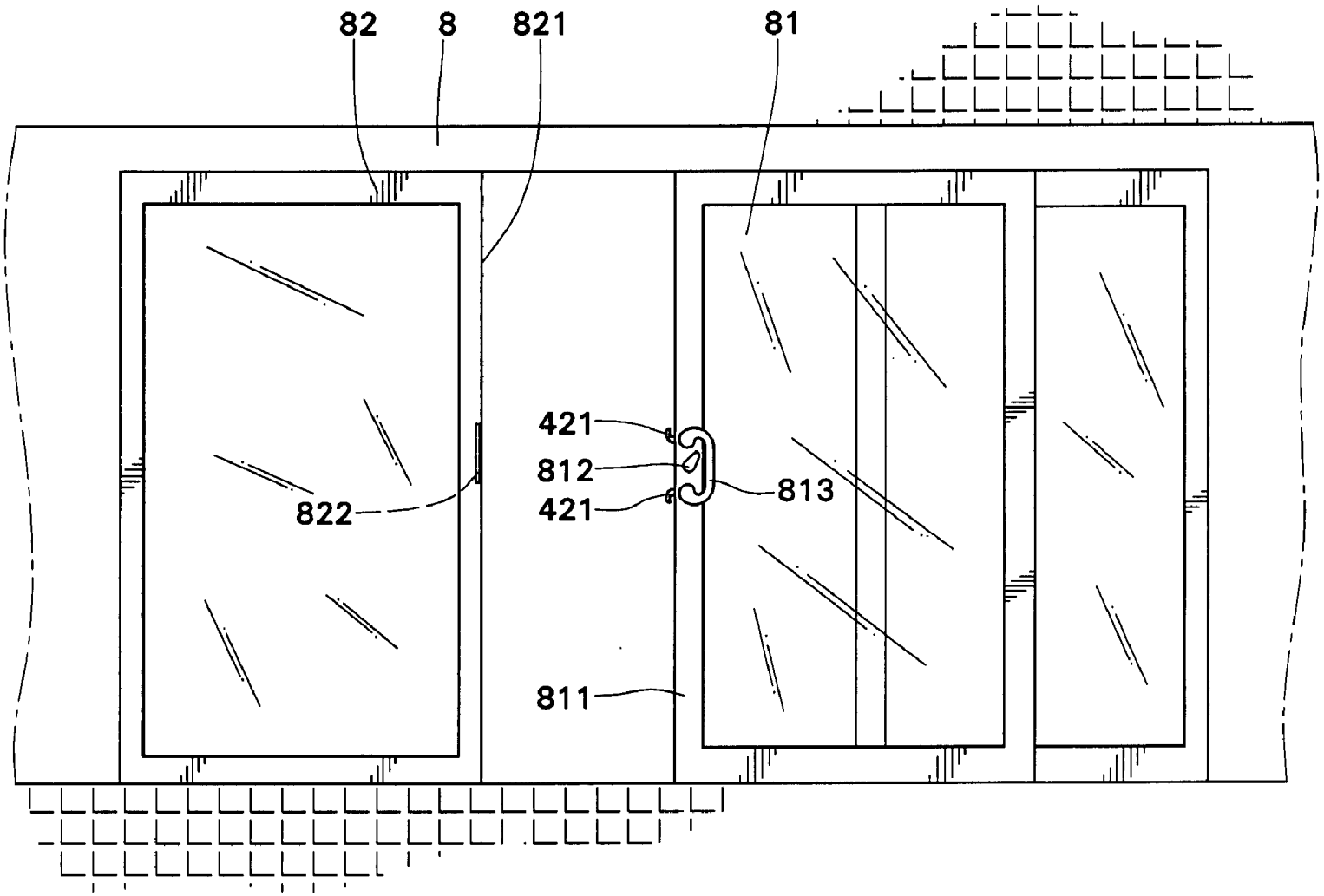
FIG. 8 is a schematic view illustrating installation of the lock assembly on a door.

Referring to FIG. 8, the lock assembly can be mounted to an inner side 811 of a sliding door 81, which, in turn, is mounted in a window of a wall 8. A lever 812 is mounted to the sliding door 81 and connected to one of the pivotal members 3 of the lock assembly. Reference number 82 denotes a fixed door having a side 821 to which a strike 822 is mounted. A user may grab a handle 813 on the sliding door 81 and move the sliding door 81 toward the fixed door 82 until the inner side 811 of the sliding door 81 is in contact with the side 821 of the fixed door 82. The lever 812 is then turned to pivot the pivotal members 3, thereby moving the lock assembly to a locking state shown in FIG. 5.

When either of the pivotable members 3 is driven by the lever 812, the other pivotal member 3 is also driven due to the arrangement of the toothed portion 31 on each pivotal member 3. Each hook member 42 is actuated such that the hooked second end 421 is moved either to the retraced position shown in FIG. 3 or to the extended position (the locking state) shown in FIG. 5. When in the locking state, the hooked second ends 421 of the hook members 42 are extended into an opening (not shown) in the strike 822 of the fixed door 82.

Figure 4:
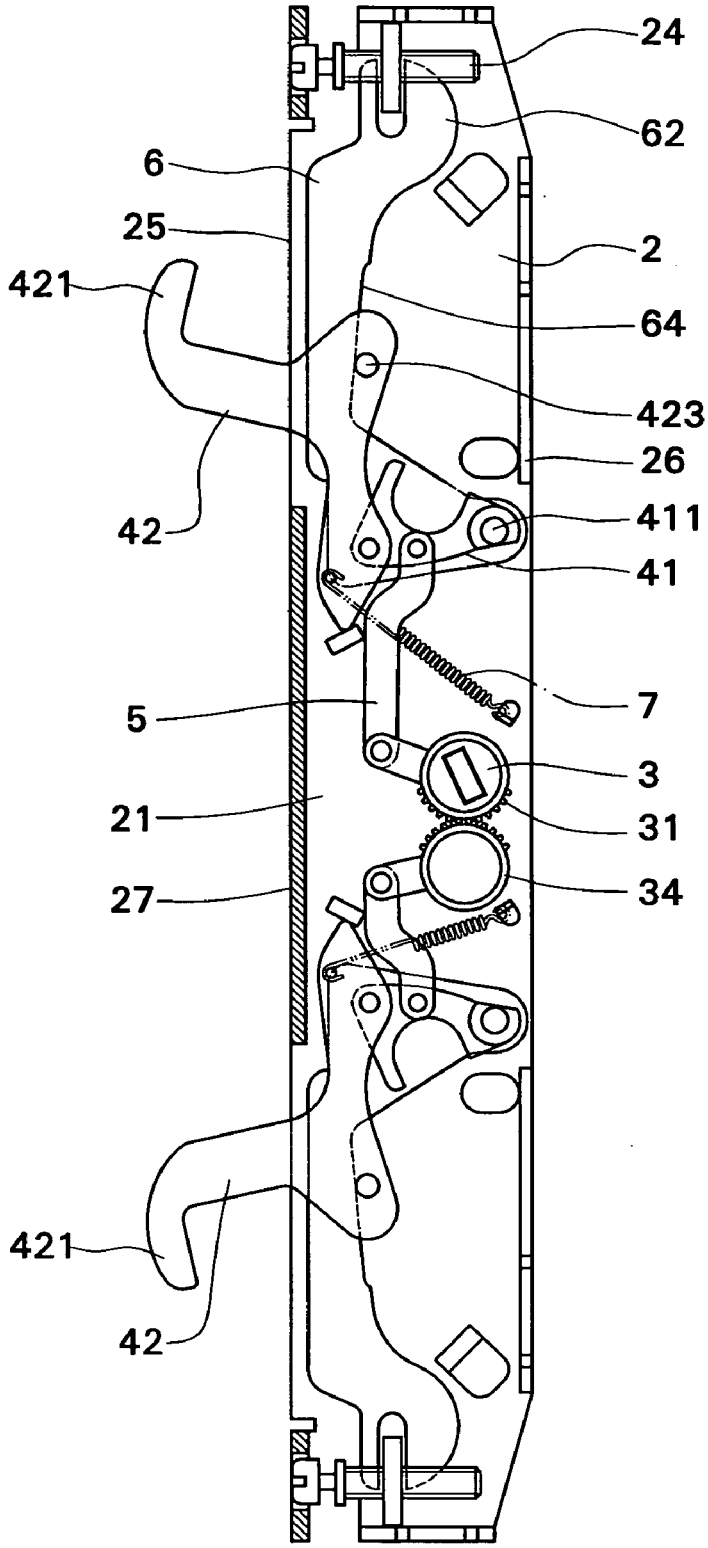
FIG. 4 is a side view similar to FIG. 3, illustrating a transition state of a locking operation of the lock assembly.

In particular, when a user is intended to switch the lock assembly from the unlocked state shown in FIG. 3 to the locking state shown in FIG. 5, when either pivotal member 3 is turned, the respective linking rod 5 is actuated to cause movement of the respective rocker arm 41 and the respective hook member 42 until the peg 423 of the respective hook member 42 abuts against an inner edge 64 of the respective guide plate 6 that faces away from an outer end face 27 of the casing 2, as shown in FIG. 4. The respective spring 7 biases the hooked second end 421 of the respective hook member 42 to a protruded position shown in FIG. 4, as inward movement of the hooked second end 421 of the respective hook member 42 would stretch the respective spring 7. Further rotation of the respective pivotal member 3 causes further pivotal movement of the respective rocker arm 41 and the respective hook member 42, in which the peg 423 of the respective rocker arm 41 moves along the inner edge 64 of the respective guide plate 6 until the respective rocker arm 41 is stopped by a stop 26 of the casing 2. Again, the respective spring 7 biases the hooked second end 421 of the respective hook member 42 to a protruded position shown in FIG. 4. The openings 25 of the casing 2 allow passage of the hooked second ends 421 of the hook members 42.

Figure 1:
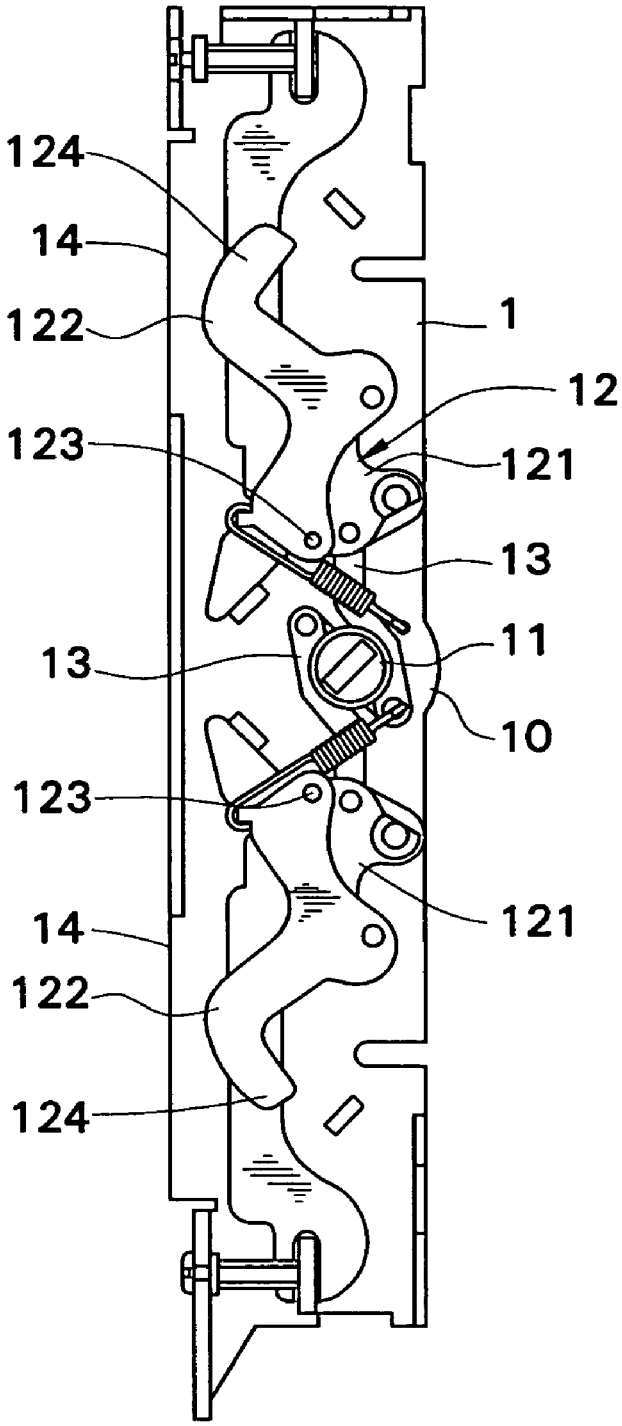
FIG .1 PRIOR ART
FIG. 1 is a side view of a conventional lock assembly with one casing half being removed to show interior structure.

The respective linking rod 5 is located between the respective pivotable member 3 and the outer end face 27 of the casing 2. It is noted that the respective linking rod 5 does not move beyond the innermost point 34 of the respective pivotable member 3 during its pivotal movement. Thus, the protruded portion 10 (FIG. 1) required in the prior art lock assembly is omitted. The overall width of the casing 2 is smaller than that of the conventional design. Preferably, the pivotable members 3 are aligned along a vertical axis.

Figure 6:
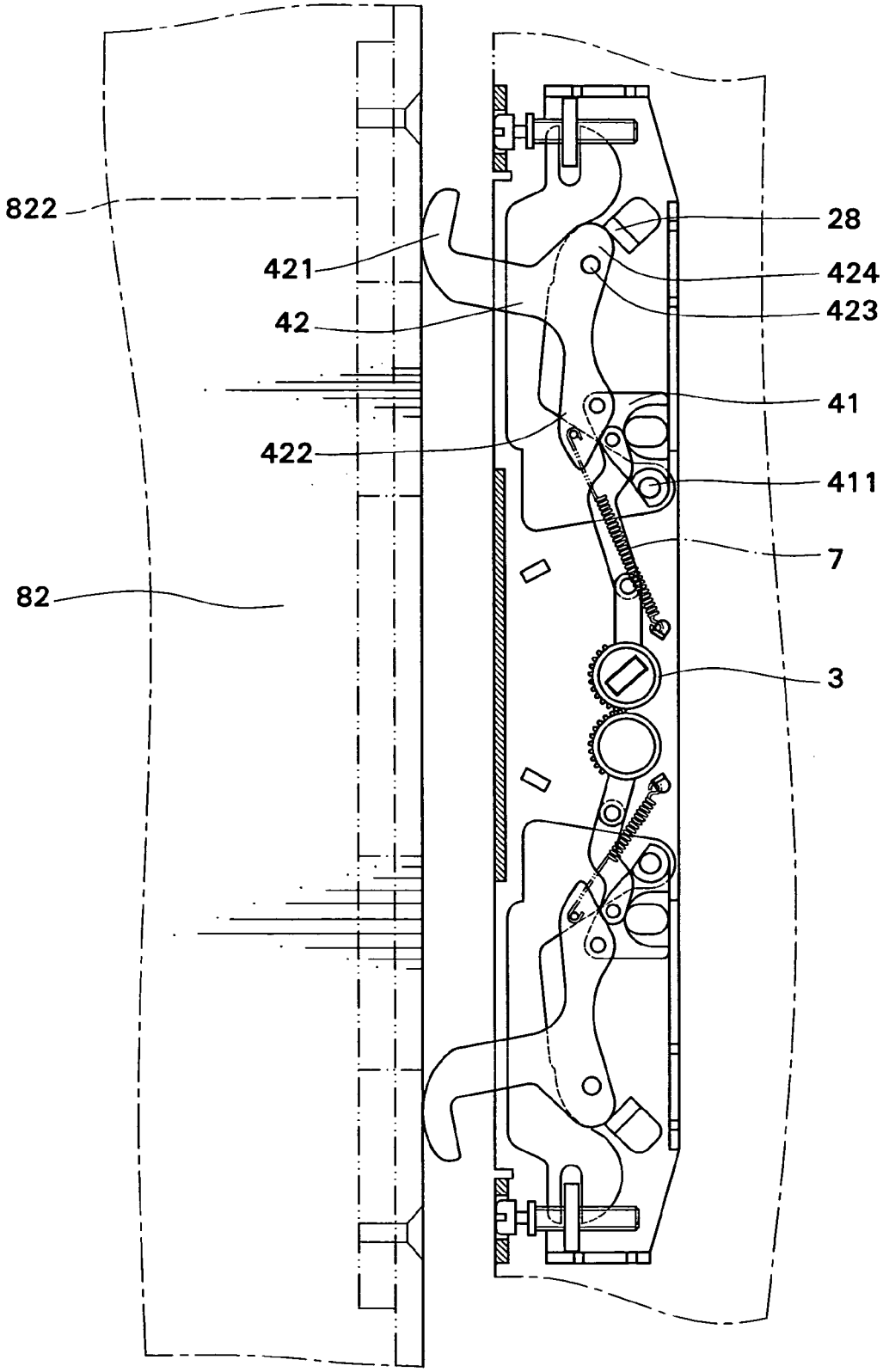
FIG. 6 is a view similar to FIG. 5, wherein the hook members are subjected to an impact.

The lock assembly in accordance with the present invention also provides a function of preventing the hook members 42 in the locking state from being damaged. In particular, when the lock assembly is in the locking state with the hooked second ends 421 of the hook members 42 exposed outside the sliding door 81, the user may not be aware of this situation and close the door. As illustrated in FIG. 6, the hooked second ends 421 of the hook members 42 are subjected to an impact when it collides against the strike 822 of the fixed door 82.

Figure 7:
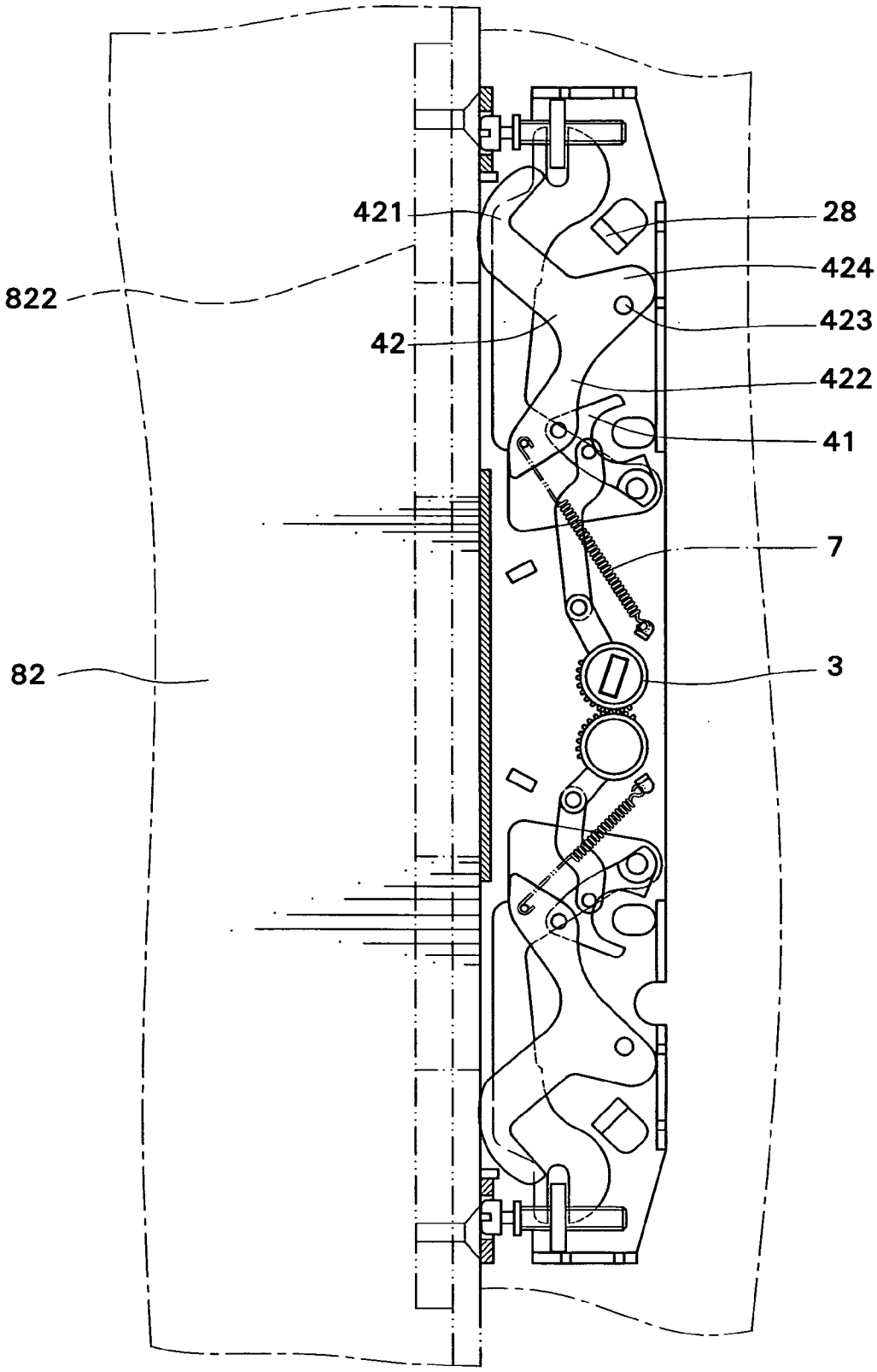
FIG. 7 is a view similar to FIG. 6, wherein the hook members are moved to their retracted position as a result of the impact.

To avoid damage to the elements of the lock assembly in accordance with the present invention, two stops 28 are provided and each of which is located adjacent to the intermediate portion 424 of the associated hook member 42. The stops 28 can be formed by means of pressing the casing 2. As illustrated in FIG. 6, when the second ends 421 of the hook members 42 are subjected to an impact exceeding a predetermined extent and thus receive a certain momentum, the hooked members 42 move inward. The pegs 423 are so located not to interfere with inward movements of the hooked members 42. During the inward movement of each hook member 42, the intermediate portion 424 of each hook member 42 presses against and is stopped by the associated stop 28. The intermediate portion 424 of each hook member 42 is preferably arcuate. Thus, the upper stop 28 imparts a downward force to the upper hook member 42 while the lower stop 28 imparts an upward force to the lower hook member 42. As a result, each hook member 42 moves to a retracted state shown in FIG. 7. Then, the hook devices 4 restore their retracted state shown in FIG. 3 under the action of the springs 7. Thus, damage to the lock assembly is prevented.

Although the invention has been explained in relation to its preferred embodiment, it is to be understood that many other possible modifications and variations can be made without departing from the scope of the invention as hereinafter claimed.

What is claimed is:

1. A lock assembly comprising:

a casing having two openings, the casing further including two stops provided thereon;

two pivotable members pivotally mounted in the casing, the pivotable members being so configured that rotation of one of the pivotable members causes rotation of the other pivotable member;

two linking rods each having a first end pivotally connected to an associated one of the pivotable members and a second end; and two hook devices each including a hook member and a rocker arm, each said rocker arm being pivotally mounted in the casing, the second end of each said linking rod being pivotally connected to an associated one of the rocker arms, each said hook member having a first end pivotally connected to an associated one of the rocker arms, each said hook member further including a hooked second end that is passable through an associated one of the openings of the casing, each said hook member further including an intermediate portion located adjacent to an associated one of the stops;

wherein when either of the pivotable members is pivoted, each said rocker arm and each said hook member are actuated such that the hooked second end of each said hook member is moved between a retracted position in the casing and a locking position out of the casing; and wherein when the hooked second end of each said hook member is in the locking position and subjected to an impact exceeding a predetermined extent, each said hook member pivots inward, with the intermediate portion of the hook member pressing against the associated one of the stops, causing the hook member to move to thereby retract the hooked second end of each said hook member into the casing.

2. The lock assembly as claimed in claim 1, wherein the casing consists of two casing halves.

3. The lock assembly as claimed in claim 1, further including two guide plates, each said guide plate including a first end pivotally connected to an associated one of the rocker arms, each said guide plate further including an inner edge facing away from an outer end face of the casing, each said hook member having a peg that moves along the inner edge of an associated one of the guide plates during a portion of a pivotal movement of said rocker arm.

4. The lock assembly as claimed in claim 1, wherein the pivotable members are aligned along a vertical axis.

5. The lock assembly as claimed in claim 1, wherein each said linking rod is located between an associated one of the pivotable members and an outer end face of the casing.

6. The lock assembly as claimed in claim 5, wherein each said linking rod does not move beyond an innermost point of an associated one of the pivotable members during a pivotal movement of each said linking rod.

7. The lock assembly as claimed in claim 1, wherein the intermediate portion of each said hook member is arcuate.

8. The lock assembly as claimed in claim 1, wherein each said pivotal member includes a toothed portion, allowing meshing of said pivotal members.

* * * * *